US011512360B2

(12) United States Patent
Kumano et al.

(10) Patent No.: US 11,512,360 B2
(45) Date of Patent: Nov. 29, 2022

(54) GRAIN-ORIENTED ELECTRICAL STEEL SHEET WITH EXCELLENT MAGNETIC CHARACTERISTICS

(71) Applicant: NIPPON STEEL CORPORATION, Tokyo (JP)

(72) Inventors: Tomoji Kumano, Tokyo (JP); Shinya Yano, Tokyo (JP); Shingo Okada, Tokyo (JP); Akio Oguri, Tokyo (JP); Shota Morimoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/253,795

(22) PCT Filed: Jun. 21, 2019

(86) PCT No.: PCT/JP2019/024818
§ 371 (c)(1),
(2) Date: Dec. 18, 2020

(87) PCT Pub. No.: WO2019/245044
PCT Pub. Date: Dec. 26, 2019

(65) Prior Publication Data

US 2021/0262052 A1 Aug. 26, 2021

(30) Foreign Application Priority Data

Jun. 21, 2018 (JP) ..... JP2018-118019

(51) Int. Cl.

| | |
|---|---|
| ***C21D 8/12*** | (2006.01) |
| ***C21D 9/46*** | (2006.01) |
| ***C22C 38/02*** | (2006.01) |

(52) U.S. Cl.
CPC ..... *C21D 8/1272* (2013.01); *C21D 9/46* (2013.01); *C22C 38/02* (2013.01); *C21D 8/1233* (2013.01);
(Continued)

(58) Field of Classification Search
CPC ..... C21D 8/1272; C21D 9/46; C21D 8/1233; C21D 2201/05; C21D 8/1227;
(Continued)

(56) References Cited

U.S. PATENT DOCUMENTS 1,965,559 A 7/1934 Goss
4,293,350 A 10/1981 Ichiyama et al.
(Continued)

FOREIGN PATENT DOCUMENTS

JP 33-4710 A 6/1958
JP 55-18566 A 2/1980
(Continued)

OTHER PUBLICATIONS

Lyakishev N.P., Encyclopedic Dictionary of Metallurgy, vol. 2, M .: Internet Engineering, 2000, p. 231-232.
(Continued)

*Primary Examiner* — Nicholas A Wang
*Assistant Examiner* — Maxwell Xavier Duffy
(74) *Attorney, Agent, or Firm* — Birch, Stewart, Kolasch & Birch, LLP

(57) ABSTRACT

A grain-oriented electrical steel sheet having a metallographic structure after secondary-recrystallized annealing including matrix grains of Goss-oriented secondary recrystallized grains, wherein an existence frequency of Goss-oriented crystal grains having a major diameter of 5 mm or less in the matrix grains is 1.5 grains/cm$^2$ or more and 8 grains/cm$^2$ or less, and the magnetic flux density B8 is 1.88 T or more, and wherein deviation angles from a rolling
(Continued)

direction of [001] direction of the Goss-oriented crystal grains having the major diameter of 5 mm or less are 7" or less and 5° or less, in terms of a simple or arithmetic average of α angle and β angle, respectively, wherein the α angle represents an angle formed by a longitudinal direction and a projection of the [001] on a specimen surface, and the β angle represents a tilt of the [001] out of the specimen surface.

2 Claims, 6 Drawing Sheets

(52) U.S. Cl.
CPC ..... *C21D 2201/05* (2013.01); *C22C 2202/02* (2013.01)

(58) Field of Classification Search
CPC ..... C21D 8/1205; C21D 8/12; C22C 38/02; H01F 1/16; H01F 1/147
See application file for complete search history.

(56) References Cited

U.S. PATENT DOCUMENTS

| | | | | |
|---|---|---|---|---|
| 4,623,407 | A | | 11/1986 | Suga et al. |
| 4,753,692 | A | | 6/1988 | Kuroki et al. |
| 4,770,720 | A | | 9/1988 | Kobayashi et al. |
| 5,702,541 | A | | 12/1997 | Inokuti et al. |
| 5,858,126 | A | * | 1/1999 | Takashima ..... C21D 8/12 148/308 |

FOREIGN PATENT DOCUMENTS

| | | | |
|---|---|---|---|
| JP | 58-23414 | A | 2/1983 |
| JP | 59-56522 | A | 4/1984 |
| JP | 59-197520 | A | 11/1984 |
| JP | 61-117218 | A | 6/1986 |
| JP | 6-100996 | A | 4/1994 |
| JP | 8-80172 | B2 | 10/1994 |
| JP | 8-213225 | A | 8/1996 |
| JP | 9-267025 | A | 11/1997 |
| JP | 2000-199015 | A | 7/2000 |

OTHER PUBLICATIONS

Office Action issued in Russian Application No. 2021101039/05(001943) dated Jul. 9, 2021, with English translation.

Nozawa, "Study on Iron Loss of Unidirectional 3% Silicon Steel Plate," Tohoku University, Doctoral Dissertation, 1979, pp. 131-141 and 167-170 (total 19 pages), with a partial English translation.

* cited by examiner

CONTOUR LINE GRAPH OF CORE LOSS W17/50 OF ELECTRICAL STEEL SHEET

GRAIN-ORIENTED ELECTRICAL STEEL SHEET WITH EXCELLENT MAGNETIC CHARACTERISTICS

TECHNICAL FIELD

The present invention relates to a grain-oriented electrical steel sheet having lower core loss properties, wherein magnetic domain refining is performed by forming Goss-oriented crystal grains having a metallurgical desirable and limited size, without performing artificial magnetic domain refining before or after secondary recrystallization.

BACKGROUND ART

Grain-oriented electrical steel sheets are widely used mainly as iron core materials for transformers, and their characteristics are graded according to core loss and magnetic flux density. The lower their core loss and the higher their magnetic flux density, the greater their value. Generally, when the magnetic flux density is increased, the secondary recrystallized grain size becomes large, so there is a trade-off relationship that core loss is deteriorated. Direction of conventional quality improvement technology is that a means to artificially reduce a magnetic domain width is applied after secondary recrystallization in order to reduce the core loss. For example, Patent Document 1 discloses a technique for controlling a magnetic domain width by laser irradiation. However, since this magnetic domain control is not heatproof, it is not suitable for applications with performing strain relief annealing, and the magnetic domain control method having a thermal stability of Patent Document 2 has been put into practical use. Further, in Patent Document 3, a method of performing a treatment before secondary recrystallization to refine magnetic domains of secondary recrystallized grains has been developed, and the method has been put into practical use. These are excellent in the effect of the refinement of the magnetic domains, but require extra processes, which causes problems that increase cost, limit production, reduce magnetic yield, destroy and need to recoat the insulation coating.

Further, according to the previous knowledge, it is possible to coexist relatively small grains in the secondary recrystallized grains having a grain size of about several centimeters in the grain-oriented electrical steel sheet. However, in this case, since the orientation of the small grains is widely deviated from the so-called Goss orientation ({110}<001>), and thus the magnetic characteristics are deteriorated, it has not been put to practical use.

PRIOR ART DOCUMENT

Patent Document

Patent Document 1: Japanese Patent Publication (Kokai) No. 55-018566
Patent Document 2: Japanese Patent Publication (Kokai) No. 61-117218
Patent Document 3: Japanese Patent Publication (Kokai) No. 59-197520
Patent Document 4: Japanese Patent Publication (Kokoku) No. 33-004710
Patent Document 5: Japanese Patent Publication (Kokai) No. 59-056522
Patent Document 6: Japanese Patent Publication (Kokai) No. 09-287025

Patent Document 7: Japanese Patent Publication (Kokai) No. 58-023414
Patent Document 8: Japanese Patent Publication (Kokai) No. 2000-199015
Patent Document 9: Japanese Patent Publication (Kokoku) No. 6-80172

Non-Patent Document

Non-Patent Document 1: Tadao Nozawa: Tohoku University Dissertation: Doctoral Dissertation 1979
Non-Patent Document 2: U.S. Pat. No. 1,965,559

SUMMARY OF THE INVENTION

Problems to be Solved by the Invention

In the grain-oriented electrical steel sheet, if a process condition for improving a magnetic flux density (for example, high cold rolling rate) is adopted, the Goss orientation of the Goss oriented grains becomes sharp in the primary recrystallization structure, but the existence frequency of the Goss oriented grains is low. As a result, the secondary recrystallized grain size becomes large, the abnormal eddy current loss increases, and the core loss deteriorates. That is, although the magnetic flux density becomes high (large), the core loss is deteriorated. This is because although the hysteresis loss is improved, the magnetic domain width is widened, the abnormal eddy current loss becomes large (increased), and the total core loss is deteriorated. Further, in the conventional technique, when fine grains were allowed to be present in the secondary recrystallized structure, the orientation of the fine grains was largely deviated from the Goss orientation. As a result, the magnetic characteristics were not improved. Therefore, in an actual industrial production, the secondary recrystallized grains must be large in order to secure a high magnetic flux density, and a method for improving core loss by an artificial additional magnetic domain control method must be adopted. One example of an artificial additional magnetic domain control method is application of a tension-imparting insulating coating, and in fact, many electrical steel sheets are produced by this method. However, thus in the conventional method, the number of steps is increased, the cost is increased, or the interlayer resistance is deteriorated due to the destruction of the insulating coating, and there is a limit to the improvement of the core loss, and the improvement has been demanded.

The object of the present invention is to provide a grain-oriented electrical steel sheet in which fine grains having a Goss orientation are present in the secondary recrystallized structure, thereby significantly improving the core loss without deteriorating the magnetic flux density. Hereinafter, the fine grains having the Goss orientation existing in the secondary recrystallized structure are referred to as "sesame-sized grains". In the present invention, sesame-sized grains are ones that have a major (long) diameter of 5 mm or less.

Means for Solving the Problems (1) A grain-oriented electrical steel sheet composed of 2.5 to 3.5% by mass of Si, with the balance of Fe and inevitable elements, and having a sheet thickness of 0.18 to 0.35 mm, wherein its metallographic structure after secondary-recrystallized annealing includes matrix grains of Goss-oriented secondary recrystallized grains, and wherein, in the metallographic structure, the existence frequency of Goss-oriented crystal grains having a major (long) diameter of 5 mm or less present in the matrix grains is 1.5 grains/$cm^2$ or more and 8 grains/$cm^2$ or less, and the magnetic flux density B8 is 1.88 T or more, wherein the deviation angles from the rolling direction of [001] direction of the Goss-oriented crystal grains are 7° or less and 5° or less in terms of a simple average of α angle and β angle, respectively, wherein the α angle and the β angle are as follows:

α angle: the angle formed by the longitudinal direction and the projection of the [001] on specimen surface β angle: the tilt of the [001] out of the specimen surface

Effect of the Invention

The presence of the Goss-oriented fine grains at a specific frequency in the secondary recrystallized structure makes it possible to obtain a grain-oriented electrical steel sheet with improved core loss without deteriorating the magnetic flux density.

EMBODIMENTS FOR CARRYING OUT THE INVENTION

A grain-oriented electrical steel sheet according to the present invention is based on the intensive studies conducted by the present inventors to solve the above-mentioned problems, and its metallographic structure is composed of a large sharp Goss-oriented secondary recrystallized grain (hereinafter referred to as "matrix grains"), and similarly sharp Goss-oriented fine grains having a major (long) diameter of 5 mm or less (hereinafter referred to as "sesame-sized grains") present in said large secondary recrystallized grains (matrix grains). Accordingly, a grain-oriented electrical steel sheet with improved magnetic domain structure in the large secondary recrystallized grains (matrix grains) and improved core loss without deteriorating magnetic flux density can be obtained. In other words, it can be said that the matrix grains and the sesame-sized grains have a sea-island relationship. Namely, sesame-sized grains, which are the islands, exist in matrix grains, which is the sea. A conventional technology (for example, Patent Document 9) discloses an electrical steel sheet having a structure in which grains having a large grains size and grains having a small grains size are mixed. However, it should be noted that the conventional technology has a structure in which small grains are present at the grain boundaries of large grains, and does not have a sea-island structure in which small grains (sesame-sized grains) are present in large grains (matrix grains). Incidentally, the electrical steel sheet according to the present invention has a sea-island structure in which small grains (sesame-sized grains) are present in large grains (matrix grains), but it should be noted that it is not denied that the small grains are present at grain boundaries of large grains. Further, the major (long) diameter of the matrix grains exceeds at least 5 mm, because the matrix grains include sesame-sized grains having a major (long) diameter of 5 mm or less. The matrix grains are secondary recrystallized grains and may have a grain size of about several centimeters, for example, a grain size of about 1 cm to 10 cm.

Also, a glass coating mainly composed of forsterite may be present on the surface of the grain-oriented electrical steel sheet of the present invention. Further, a tension film may be applied thereon.

Details are given below.

<Crystal Orientation>

Figure 1:
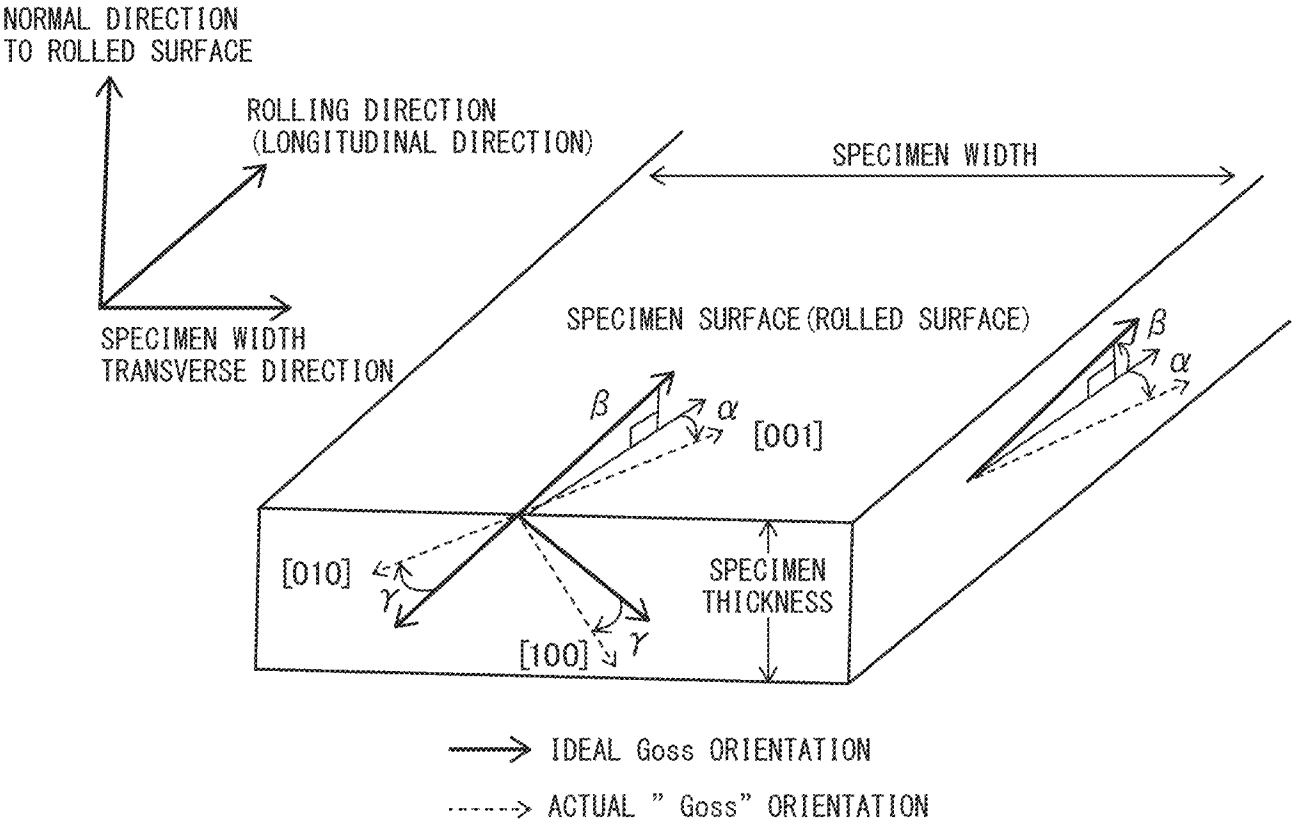
FIG. 1 is a diagram showing a three-dimensional angular relationship between three directions for a steel sheet (rolling direction, normal direction of rolled surface, steel sheet width direction) and three orientations (<001>) of Goss orientation crystal, which is indicated with three angles (α, β, γ angles).

First, the orientation of the secondary recrystallized grains of the grain-oriented electrical steel sheet will be described. The grain-oriented electrical steel sheet utilizes a secondary recrystallization phenomenon to form huge Goss-oriented grains. This Goss orientation is represented by an index of {110} <001>. The Goss orientation sharpness of the grain-oriented electrical steel sheet largely depends on a deviation of the <100> orientation of crystal lattice from the rolling direction. Specifically, as shown in FIG. 1, the deviation angle is defined by three angles in a three-dimensional space, and the angles α, β and γ are defined below (Non-Patent Document 1).

α: the angle formed by the longitudinal direction and the projection of the [001] on specimen surface β: the tilt of the [001] out of the specimen surface γ: the angle of rotation of the specimen about the [001] from the equiangular position [0011]

As described above, the α and β angles include a shift or deviation from the [001] axis of the Goss-oriented grains from the rolling direction or the specimen surface. Therefore, when the shift or the deviation becomes large, the easy magnetization axis <001> of the Goss-oriented grains is greatly shifted or deviated from the rolling direction, and the magnetic properties in the rolling direction deteriorate. On the contrary, since the γ angle is an angle around the [001] axis (easy axis of magnetization) of the Goss-oriented grains, it does not adversely affect the magnetic flux density. Rather, it is said that the larger the γ angle is, the greater the magnetic domain refining effect is, which is desired.

Here, the crystal lattice of grain-oriented electrical steel sheet is body-centered cubic crystal. The symbols [ ] and ( ) indicate the unique direction and the plane normal direction, and the symbols < > and { } indicate the equivalent orientation and the plane normal orientation of the cubic crystal. Further, in FIG. 1, [100], [010] and [001] directions unique in the right-handed coordinate system regarding the Goss orientation are defined. Further, regarding "direction", a unique case is defined as "direction", and an equivalent case is defined as "orientation".

Figure 2:
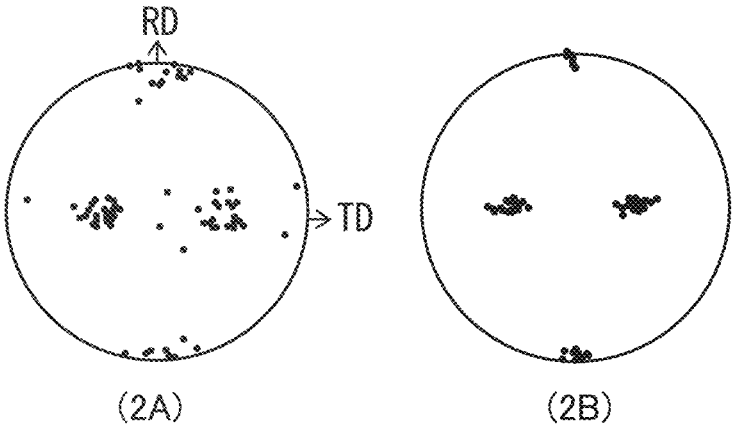
FIG. 2 is a diagram showing an example of the crystal orientation of sharp Goss-oriented fine grains (sesame-sized grains) having a major (long) diameter of 5 mm or less.

FIG. 2 shows an example of a {200} pole figure of sesame-sized grains. (2A) is a case where it is manufactured by a conventional method in which sharpness of a rolling direction, described later, is more than 7, and (2B) is an example of the electrical steel sheet according to the present invention. Both of them are measured orientation values of crystal grains having a major (long) diameter of 5 mm or less, and the core loss of (2B) is extremely good.

<Composition>

The composition of elements will be explained below. Hereinafter, % means mass %.

Si: 2.5-3.5%

Si is an element that increases the specific resistance and contributes to the improvement of core loss characteristics. If it is less than 2.5%, the specific resistance decreases and the core loss deteriorates. If it is more than 3.5%, breakage frequently occurs in the manufacturing process, especially in rolling, which makes practical commercial production impossible.

The components necessary for the grain-oriented electrical steel sheet are Fe and Si, but the remainder of elements that inevitably exist are described below.

The elements that are eventually inevitably contained in the metal part of the steel sheet except on its surface include Al, C, P, Mn, S, Sn, Sb, N, B, Se, Ti, Nb, Cu, etc. They are distinguished into elements that are inevitably incorporated during the industrial production and elements that are artificially added to cause secondary recrystallization in the grain-oriented electrical steel sheet. It is desired that these inevitable elements are unnecessary or present in a small amount in the final product.

C is necessary in the manufacturing process for texture improvement. However, it is required to be present in a small amount in the final product in order to prevent magnetic aging, and the preferable upper limit amount thereof is 0.005% or less, and more preferably 0.003% or less.

Elements which do not cause magnetic aging but are artificially added and unnecessary in the final product, include P, N, S, Ti, B, Nb, Se, etc. The upper limit amount of these elements are also preferably 0.005% or less, and more preferably 0.0020% or less. Al is not always unnecessary because it exists as mullite in the glass film.

Al, Mn, Sn, Sb and Cu are metallic elements, and there are those that are inevitably present and those that are intentionally added. They remain in the final product. It is also preferable that these are present in a small amount, since they deteriorate the saturation magnetic flux density. However, it is inevitable and acceptable that a maximum of about 0.01% remains in the actual manufacturing. The actual content may be adjusted depending on the manufacturing process.

The content of each element in the grain-oriented electrical steel sheet according to the present invention, and the slab and the like for producing the same, may be analyzed with the conventional methods, depending on the kind of the element.

<Product Thickness>

Product thickness is up to 0.18 mm in an actual production. It is possible to produce steel sheets thinner than 0.18 mm, but when the work-roll diameter is large, it is not possible to perform rolling while sufficiently satisfying the thickness accuracy (sheet thickness tolerance is less than 5%). The upper limit of the thickness is 0.35 mm or less, which is the upper limit of the Japanese Industrial Standard, because the absolute value of core loss for the grain-oriented electrical steel sheet becomes large with thickness increase. In the technique of the present invention, it is essential that the magnetic flux density B8 is 1.88 T or more with the presence of fine secondary recrystallized grains (sesame-sized grain).

<Crystalized Grains>

As is well-known, the core loss of the grain-oriented electrical steel sheet consists of hysteresis loss, classical eddy current loss and abnormal eddy current loss.

Classical eddy current loss largely depends on the specific resistance and sheet thickness. Therefore, it is considered to be the same when the Si content and sheet thickness are the same even if the secondary recrystallized grain size is different.

The hysteresis loss and abnormal eddy current loss largely depend on the secondary recrystallized grain size (to be precise, grain boundary area). The hysteresis loss increases with a large grain boundary area, and the sesame-sized grain (having a small grain boundary area) does not increase the hysteresis loss. On the other hand, the core loss of the grain-oriented electrical steel sheet depends not only on the grain size but also on the magnetic domain structure within the grain. More specifically, the present inventors have found that the effect of narrowing the magnetic domain width in large recrystallized grains (matrix grains or non-sesame-sized grains) can be obtained due to sharp Goss-oriented sesame-sized grains. In other words, with only large secondary recrystallized Goss grains, the magnetic domain width in the grains inevitably widens and abnormal eddy current loss increases, but it is considered that due to sesame-sized grains with a good orientation (with a sharp Goss orientation), the magnetic domain width within a large grain is narrowed (magnetic domain refining), and the abnormal eddy current loss is improved. As described above, while sesame-sized grains can provide a magnetic domain refining effect, it is concerned that sesame-sized grains may provide an effect of an increase in hysteresis loss. However, it is currently difficult to quantitatively compare and explain both of the effects. Nevertheless, since the sesame-sized grains have a good orientation in the present invention, it is presumed that this deterioration is small. Further, the abnormal eddy current loss improved by the magnetic domain refining effect due to the sesame-sized grains is proportional to the square of the domain wall displacement speed, and the displacement speed is considered to be approximately proportional to the displacement distance. Therefore, as the crystal grain size is smaller (the displacement distance is shorter) when the crystal orientation is the same, the abnormal eddy current loss becomes smaller, i.e., the effect of reducing the abnormal eddy current loss is considered to be greater.

Figure 3:
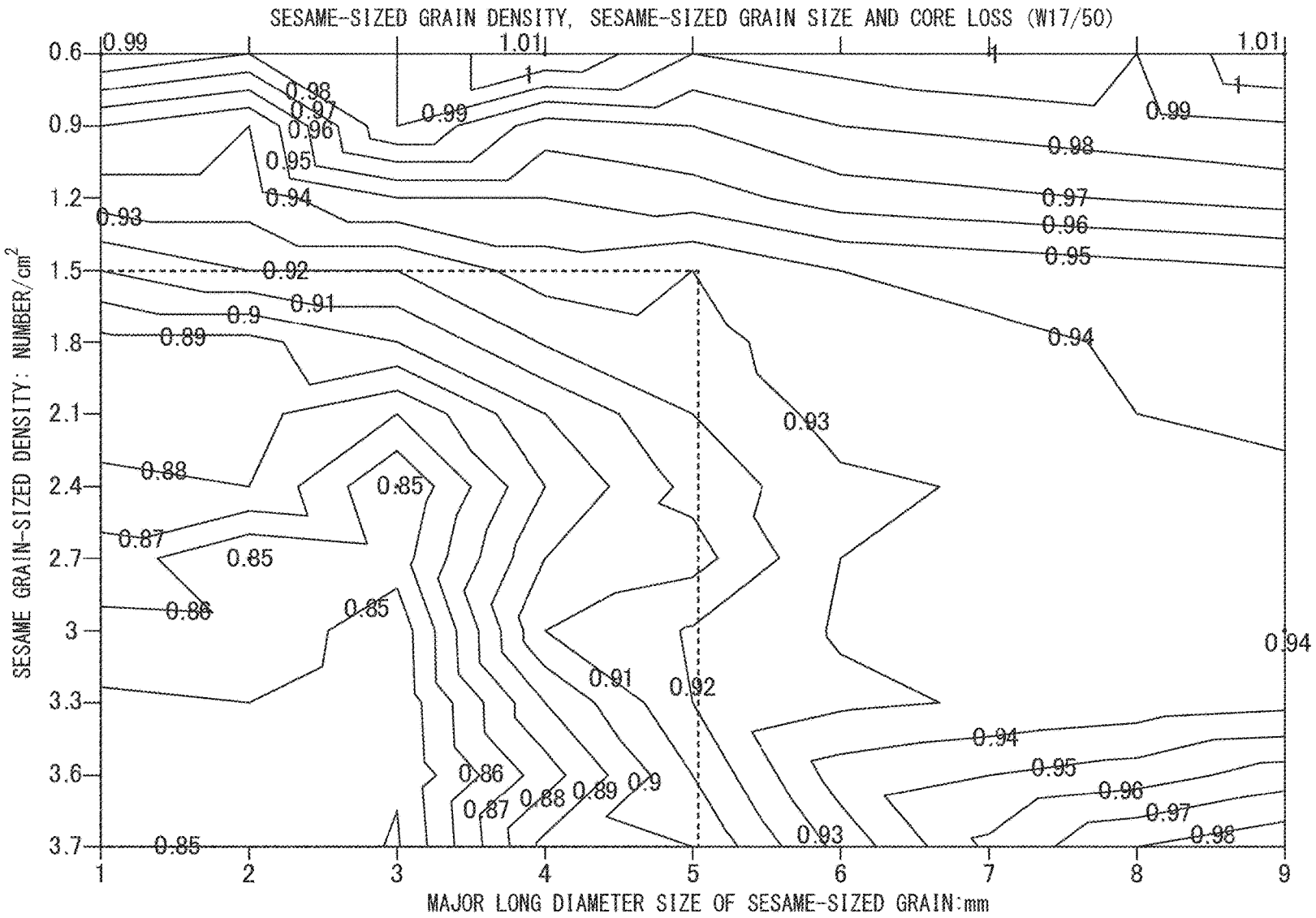
FIG. 3 is a diagram showing the relationship between the major (long) diameter of sharp Goss-oriented fine grains (sesame-sized grains) and the existence density of sesame-sized grains, and the core loss (W17/50).

When the orientation of sesame-sized grains is the same as that of coarse grains (matrix grains) as in the present invention, the total core loss becomes good due to the magnetic domain refining effect even if the existence density of sesame-sized grains is considerably large. FIG. 3 shows the reasons for limiting the existence density and size. The reason why the major (long) diameter of the sesame-sized grains is limited to 5 mm or less is that the β angle becomes large when the major (long) diameter exceeds 5 mm. As a result, the core loss deteriorates as shown in FIG. 3. At present, the reason why the β angle becomes large is not clear.

Also, the number density of sesame-sized grains in the metallographic structure is set to 1.5 number/$cm^2$ or more so as to make the core loss good as shown in FIG. 3. In general, the higher the number density, the better the core loss, and the more preferable number density may be 2.0 pieces/$cm^2$ or more. The upper limit of the sesame-sized grains is set to 8 number/cm$^2$, because the electrical steel sheet having a secondary recrystallized structure having a good Goss orientation with more than 8 number/cm$^2$ cannot be commercially produced at present.

FIG. 3 shows data when the Si content is 3.25 to 3.40% and the grain-oriented electrical steel sheet having a sheet thickness of 0.27 mm has a magnetic flux density B8 of 1.91 to 1.94 T (the density of sesame-sized grains, the major (long) diameter of sesame-sized grains and the core loss (W17/50)) are summarized. Incidentally, the core loss (W17/50) means the core loss measured when the maximum magnetic flux density is 1.7 T and the frequency is 50 Hz.

<Density of Sesame-Sized Grains>

Figure 5:
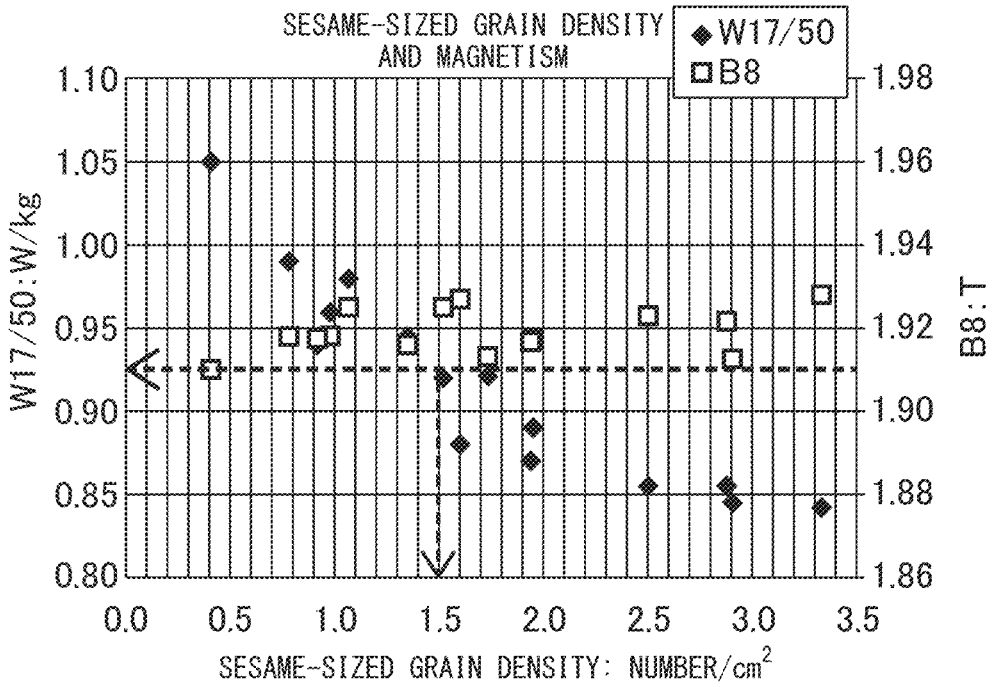
FIG. 5 is a diagram showing the relationship between the density of sharp Goss oriented fine grains (sesame-sized grains), and the core loss and magnetic flux density.

From FIGS. 3 and 5, the lower limit of the density of sesame-sized grains is 1.5 number/cm$^2$, and the upper limit is 8 number/cm$^2$ where half of the entire metallographic structure is occupied by sesame-sized grains to cause secondary recrystallization failure.

Assuming that the sesame-sized grains are rectangular and the average length of one side is 2.5 mm, the average area of the sesame-sized grains is 2.5×2.5=6.25 mm$^2$/grain. In addition, assuming that the area occupied by sesame-sized grains occupies half of the metallographic structure of 100 mm$^2$ (1 cm$^2$), it will be 50 mm$^2$. Therefore, when the sesame-sized grains occupy half of the entire metallographic structure, the density of the sesame-sized grains is 50 mm$^2$/6.25 mm$^2$/grains=8 grains/cm$^2$. If the density of the sesame-sized grains is 8 grains/cm$^2$ or more, commercial products cannot be obtained due to secondary recrystallization failure. The density of sesame-sized grains is measured by observing a surface of a steel sheet visually or with a magnifying glass, on which glass film is removed.

<α Angle, β Angle>

Figure 6:
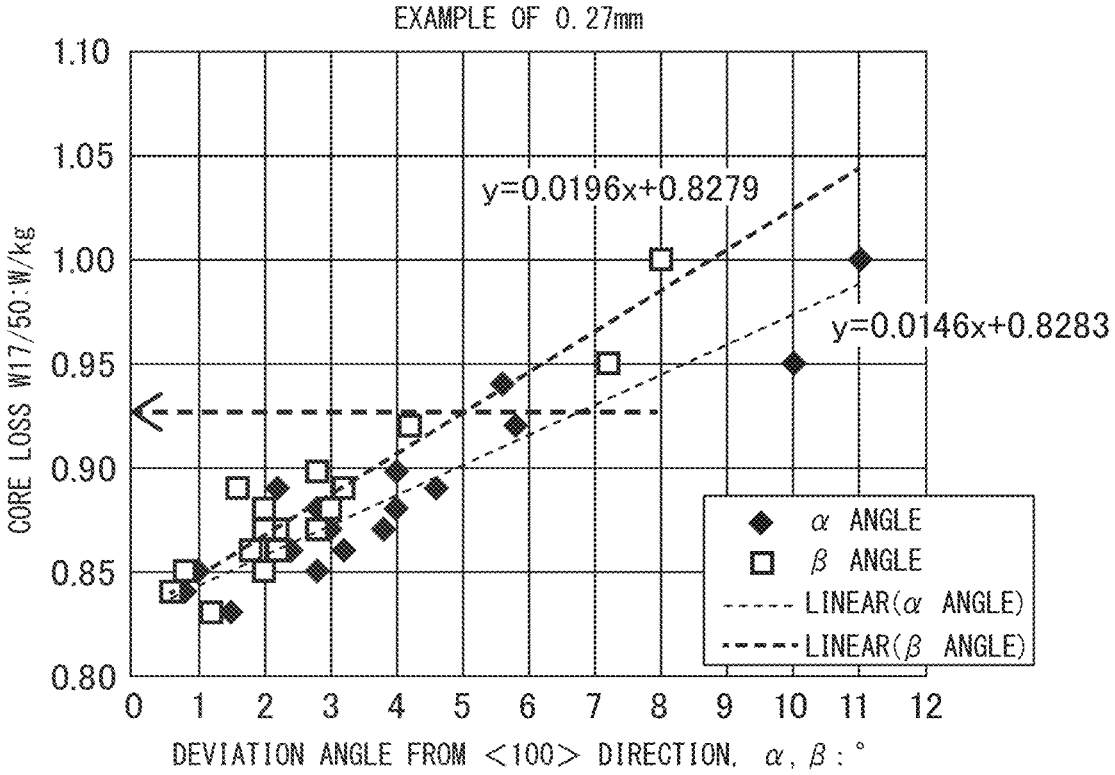
FIG. 6 is a diagram showing the relationship between the orientation of sharp Goss-oriented fine grains (sesame-sized grains) and core loss.

From FIG. 6, it is confirmed that the core loss is good (the core loss is preferably 0.93 or less) when the α angle and the β angle are 7° or less and 5° or less, respectively. This difference is considered as follows. In α and β, the rotation angle (angular distance) from the Goss orientation to the hard axis of magnetization is larger in a, so the magnetic domain refining effect in non-fine grains (matrix grains) is large, and the effect is estimated to be effective in a wider rotation angle range. This is because if the upper limit is exceeded, the shift or deviation from the Goss orientation becomes large and the magnetic flux density often becomes less than 1.88 T.

Note that the crystal orientation is measured by the single crystal orientation measurement, Laue method. In the Laue method, the central region of each grain is irradiated with X-ray and measured for each grain.

<Manufacturing Method>

A method for obtaining a grain-oriented electrical steel sheet having these characteristics will be explained.

The electrical steel sheet manufactured with the present invention relates to that specified in Japanese Industrial Standard JIS C 2553 (grain-oriented electrical steel strip) and is mainly used as an iron core for a transformer.

By the way, the origin of grain-oriented electrical steel goes back in history to N. P. Goss's Non-Patent Document 2.

The methods are subsequently described in many specifications of the inventions such as Patent Document 4 and Patent Document 5. Among them, the electrical steel sheet of the present invention relates to a grain-oriented electrical steel sheet having AlN as a main inhibitor, and has a final cold rolling rate of more than 80%. As related technical examples, Patent Documents 6, 7 and 8 can be mentioned.

Figure 7:
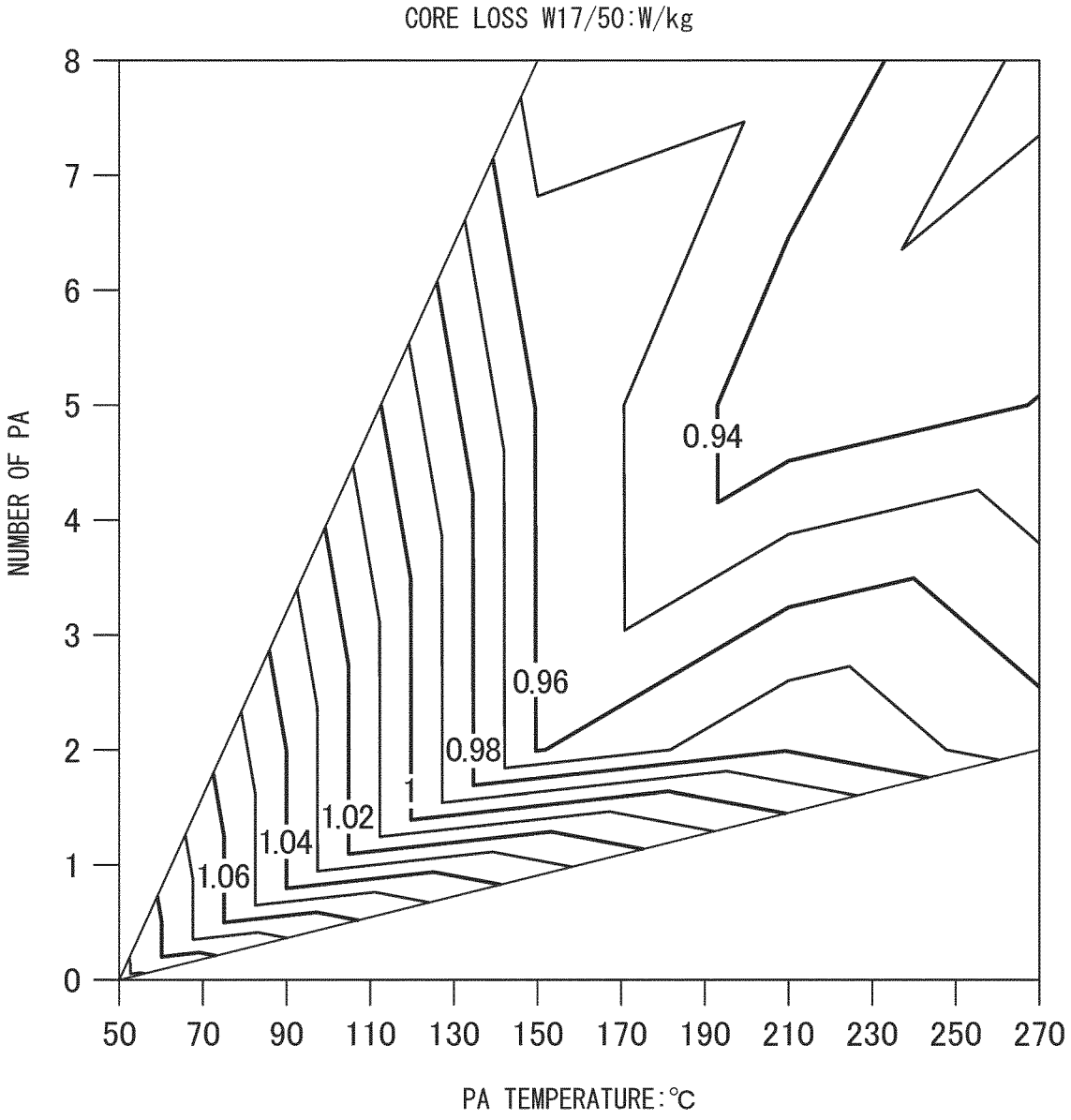
FIG. 7 is a contour line graph of the core loss W17/50 of the electrical steel sheet (without tension insulating coating).

Specifically, for example, as slab compositions, in a weight ratio (mass %), C: 0.035 to 0.075%, Si: 2.5 to 3.50%, acid-soluble A 1: 0.020 to 0.035%, N: 0.005 to 0.010%, at least one of S and Se: 0.005 to 0.015%, Mn: 0.05 to 0.8%, and optionally, at least one of Sn, Sb, Cr, P, Cu and Ni: 0.02 to 0.30% and the balance being Fe and inevitable impurities is prepared. This slab is heated at a temperature of less than 1280° C., hot-rolled, hot-rolled sheet annealed, cold-rolled with one or more of an intermediate anneal, and subject to nitriding treatment in a mixed gas of hydrogen, nitrogen and ammonia under conditions that allow strips to run during and after decarburization annealing. If the slab heating temperature is 1280° C. or higher, the nitriding treatment may not be performed. Then, an annealing separator containing MgO as a main component is applied to perform a final finish annealing. The final cold rolling thereafter is performed by reverse rolling. This cold rolling mill has a work roll radius R (mm) of 130 mm or more, keep the steel sheet at 150° C. to 300° C. for 1 minute or more in at least 3 passes of a plurality of passes. Further, the rolling shape ratio in two or more of the plurality of passes is 7 or more for production. FIG. 7 is a contour line graph of core loss W17/50 of an electrical steel sheet having a product thickness of 0.27 mm (without a tension insulating coating), wherein the horizontal axis is the steel plate holding temperature during cold rolling, and the vertical axis is the number of passes of cold rolling. From FIG. 7, a region where the core loss is favorable is observed at a holding temperature of 150° C. or higher, and the number of passes of 2 to 3 or more. Based on this, the final cold rolling process conditions for obtaining the electrical steel sheet of the present invention were determined. Note that, in FIG. 7, a steel sheet to which the tension insulating coating is not applied is used, and its core loss is inferior to the steel sheets of the same thickness shown in Tables 1 and 2 according to the examples described later.

From the viewpoint of a realistic process, it is difficult to secure a steel sheet at 150 to 300° C. for 1 minute or more during 3 passes or more, unless the process is a reverse rolling. Therefore, a reverse rolling is substantially adopted in the final cold rolling step of the steel sheet of the present invention.

Furthermore, the rolling shape ratio, m is defined by the following formula.

$$m = \frac{2\sqrt{R(H1 - H2)}}{H1 + H2} \quad \text{[Formula 1]}$$

wherein R: roll radius (mm), H1: entrance side sheet thickness (mm), and H2: exit side sheet thickness (mm).

The reason for the effect of cold rolling is not clear. However, it is possible to present, in large sharp Goss-oriented secondary recrystallized grains (matrix grains), similar sharp Goss-oriented fine grains (sesame-sized grains) having a major (long) diameter of 5 mm or less at a specific frequency, by manufacturing under the above manufacturing conditions, particularly at the temperature in the final cold rolling, the number of passes, and the rolling shape ratio. Since this metallographic structure improves the magnetic domain structure in the large secondary recrystallized grains, it is considered that the grain-oriented electrical steel sheet with improved core loss can be obtained without deteriorating the magnetic flux density.

EXAMPLES

Example 1

Figure 4:
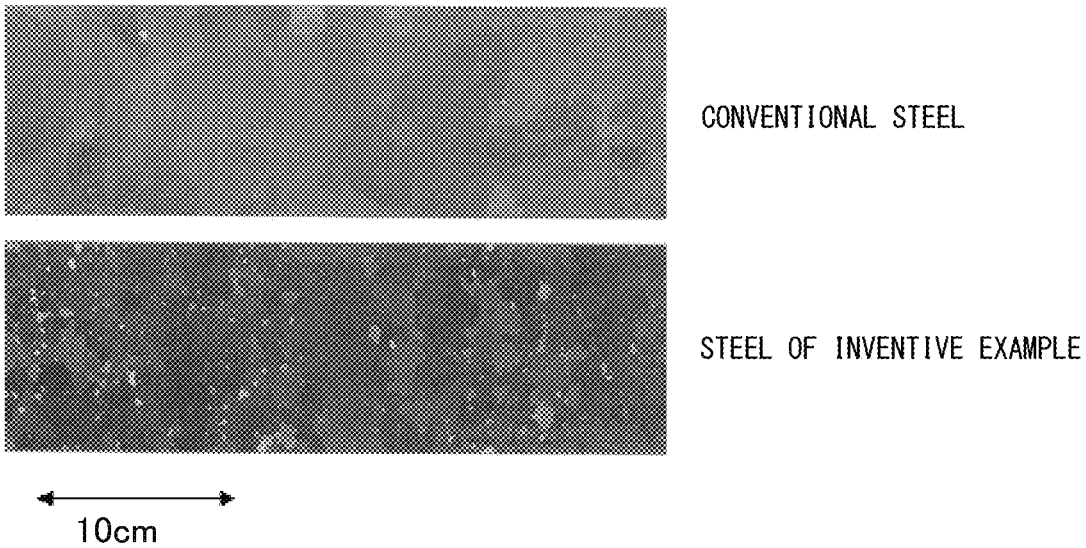
FIG. 4 is a diagram showing a secondary recrystallized macrostructure. The lower figure represents the steel of the present invention, and the upper figure represents the conventional steel.

Table 1 shows the results of the grain-oriented electrical steel sheet produced according to the above process conditions, with the Si content contained in the steel sheet being 2.45 to 3.55%. In some comparative examples, grain-oriented electrical steel sheets were manufactured under conditions that the Si content is out of the range of the present invention or the above process conditions (particularly, the number of passes with a rolling shape ratio of 7 or more) are not satisfied. Inventive Examples A1 to A7 in which the existence frequency of sesame-sized grains is within the range of the present invention have a good core loss, whereas Comparative Examples a1 to a5 in which the existence frequency of sesame-sized grains is outside the range of the present invention is inferior in core loss or did not yield a product. The core loss tends to deteriorate as the sheet thickness increases, in general. The core loss of Inventive Example A4 seems to be inferior because the sheet is thicker. In addition, in Inventive Examples A1 to A7, it was confirmed that the sesame-sized grains were present in the large matrix grains as shown in the observation photograph of FIG. 4.

TABLE 1

Results of Magnetic Properties of Resulting Grain-oriented Electrical Steel Sheet

| | Symbols | Chemical Composition Si (mass %) | Sheet Thickness (mm) | Sesame Grains*1 Existence Frequency (number/cm$^2$) | Magnetic Flux Density B8 (T) | Core Loss W17/50 (W/kg) | Remarks Number of Passes with Rolled Shape Ratio of 7 or more |
|---|---|---|---|---|---|---|---|
| Inventive Example | A1 | 2.55 | 0.27 | 2.5 | 1.945 | 0.915 | 3 |
| | A2 | 3.45 | 0.27 | 1.95 | 1.924 | 0.845 | 3 |
| | A3 | 3.2 | 0.18 | 1.6 | 1.908 | 0.791 | 3 |
| | A4 | 3.2 | 0.35 | 1.74 | 1.945 | 1.047 | 2 |
| | A5 | 3.25 | 0.27 | 1.52 | 1.921 | 0.918 | 4 |
| | A6 | 3.25 | 0.27 | 2.9 | 1.925 | 0.847 | 5 |
| | A7 | 3.25 | 0.27 | 3.33 | 1.919 | 0.845 | 5 |
| Comparative Example | a1 | 2.45 | 0.285 | 2 | 1.94 | 1.101 | 1 |
| | a2 | 3.55 | — | — | — | — | Not capable of cold rolling |
| | a3 | 3.27 | 0.15 | — | — | — | Not capable of yielding product |
| | a4 | 2.93 | 0.38 | 2.5 | 1.873 | 1.252 | 1 |
| | a5 | 3.23 | 0.27 | 0.2 | 1.914 | 1.012 | 0 |

*1sharp Goss-oriented fine grains having a major (long) diameter of 5 mm or less

Example 2

Table 2 shows the relationship of the existence frequency and orientation of sesame-sized grains having a major (long) diameter of 5 mm or less and the magnetic properties. The results are of products manufactured under the conditions that, based on Japanese Patent Publication (Kokoku) No. 60-48886, the slab heating temperature was 1350° C. and nitriding treatment was not performed. The final cold-rolling was performed under the above process conditions. The number of passes with a rolling shape ratio of 7 or more is as described in the Remarks column. The product thickness is 0.27 mm. In this range, the higher the existence frequency of sesame-sized grains is, or the smaller the total deviation angles α and β are, the better the core loss is without deterioration of the magnetic flux density. In addition, also in Inventive Examples B1 to B4, it was confirmed that the sesame-sized grains were present in the large matrix grains as shown in the observation photograph of FIG. 4.

TABLE 2

Relationship of Existence Frequency of Sesame-sized Grains, Orientation and Magnetic Properties

| | Symbols | Chemical Composition Si (mass %) | Sheet Thickness (mm) | Sesame-sized Grains*1 Existence Frequency (number/cm$^2$) | Deviation Angle*2 α angle (°) | Deviation Angle*2 β angle (°) | Magnetic Flux Density B8 (T) | Core Loss W17/50 (W/kg) | Remarks Number of Passes with Rolled Shape Ratio of 7 or more |
|---|---|---|---|---|---|---|---|---|---|
| Inventive Example | B1 | 3.2 | 0.27 | 1.74 | 3.1 | 2.0 | 1.931 | 0.871 | 3 |
| | B2 | 3.25 | 0.27 | 1.52 | 2.5 | 3.5 | 1.929 | 0.89 | 3 |
| | B3 | 3.25 | 0.27 | 2.9 | 0.6 | 1. 1 | 1.934 | 0.847 | 5 |
| | B4 | 3.25 | 0.27 | 3.33 | 0.7 | 0.8 | 1.936 | 0.845 | 5 |

TABLE 2-continued

Relationship of Existence Frequency of Sesame-sized Grains, Orientation and Magnetic Properties

| Symbols | Chemical Composition Si (mass %) | Sheet Thickness (mm) | Sesame-sized Grains*1 Existence Frequency (number/cm$^2$) | Deviation Angle*2 α angle (°) | Deviation Angle*2 β angle (°) | Magnetic Flux Density B8 (T) | Core Loss W17/50 (W/kg) | Remarks Number of Passes with Rolled Shape Ratio of 7 or more |
|---|---|---|---|---|---|---|---|---|

*1sharp Goss-oriented fine grains having a major (long) diameter of 5 mm or less

*2deviation angle of [001] axis direction of Goss-oriented grain from rolling direction or specimen surface

The invention claimed is:

1. A grain-oriented electrical steel sheet composed of 2.5 to 3.5% by mass of Si, with a balance being Fe and inevitable elements, and having a sheet thickness of 0.18 to 0.35 mm, wherein its metallographic structure after secondary-recrystallized annealing includes matrix grains of Goss-oriented secondary recrystallized grains, and wherein, in the metallographic structure, an existence frequency of Goss-oriented crystal grains having a major or long diameter of 5 mm or less present in the matrix grains is 1.5 grains/cm$^2$ or more and 8 grains/cm$^2$ or less, and the magnetic flux density B8 is 1.88 T or more, wherein deviation angles from a rolling direction of [001] direction of the Goss-oriented crystal grains having the major or long diameter of 5 mm or less are 7° or less and 5° or less, in terms of a simple or arithmetic average of α angle and β angle, respectively, wherein the α angle and the β angle are as follows:

α angle; an angle formed by a longitudinal direction and a projection of the [001] on specimen surface, and β angle; a tilt of the [001] out of the specimen surface.

2. A grain-oriented electrical steel sheet comprising 2.5 to 3.5% by mass of Si, with a balance comprising Fe and inevitable elements, and having a sheet thickness of 0.18 to 0.35 mm, wherein its metallographic structure after secondary-recrystallized annealing includes matrix grains of Goss-oriented secondary recrystallized grains, and wherein, in the metallographic structure, an existence frequency of Goss-oriented crystal grains having a major or long diameter of 5 mm or less present in the matrix grains is 1.5 grains/cm$^2$ or more and 8 grains/cm$^2$ or less, and the magnetic flux density B8 is 1.88 T or more, wherein deviation angles from a rolling direction of [001] direction of the Goss-oriented crystal grains having the major or long diameter of 5 mm or less are 7° or less and 5° or less, in terms of a simple or arithmetic average of α angle and β angle, respectively, wherein the α angle and the β angle are as follows:

α angle; an angle formed by a longitudinal direction and a projection of the [001] on specimen surface, and β angle; a tilt of the [001] out of the specimen surface.

* * * * *